US009441875B1

(12) United States Patent
Froehlich et al.

(10) Patent No.: US 9,441,875 B1
(45) Date of Patent: Sep. 13, 2016

(54) STORAGE ASSEMBLIES FOR DISCRETE STORAGE UNITS

(71) Applicant: Electrolux Home Products, Inc., Charlotte, NC (US)

(72) Inventors: Kurt Michael Joseph Froehlich, Santa Lucia di Piave (IT); David Simoni, Greenville, SC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 0 days.

(21) Appl. No.: 14/692,910

(22) Filed: Apr. 22, 2015

(51) Int. Cl.

| | |
|---|---|
| ***A47B 96/04*** | (2006.01) |
| ***F25D 25/00*** | (2006.01) |
| ***F25D 23/00*** | (2006.01) |
| *B65D 33/16* | (2006.01) |
| *A47F 5/00* | (2006.01) |

(52) U.S. Cl.
CPC ..... *F25D 25/00* (2013.01); *F25D 23/00* (2013.01); *A47F 5/0006* (2013.01); *B65D 33/1666* (2013.01); *F25D 2300/00* (2013.01); *F25D 2325/00* (2013.01)

(58) Field of Classification Search
CPC .. A47F 5/0838; A47F 5/0846; A47F 5/0006; A47F 5/00; A47F 13/085; B65D 33/1666; B65D 33/14; A47B 96/025
See application file for complete search history.

(56) References Cited

U.S. PATENT DOCUMENTS

| | | | | |
|---|---|---|---|---|
| 1,417,009 | A | 5/1922 | Woodward | |
| 1,613,447 | A * | 1/1927 | Ellberg | A47B 61/003 108/29 |
| 3,312,379 | A | 4/1967 | Gunzberg | |
| 4,442,993 | A * | 4/1984 | Tseng | F16B 21/165 248/327 |
| 4,832,290 | A | 5/1989 | Baglio | |
| 4,854,530 | A | 8/1989 | Baglio | |
| 5,094,414 | A | 3/1992 | Eddy | |
| 6,648,153 | B2 | 11/2003 | Holmes | |
| 7,165,684 | B2 * | 1/2007 | Ferron | B62H 3/12 211/118 |
| 8,215,500 | B2 | 7/2012 | Constantine | |
| 2003/0102788 | A1 | 6/2003 | Dallman et al. | |

(Continued)

FOREIGN PATENT DOCUMENTS

| | | |
|---|---|---|
| EP | 1 621 835 A2 | 2/2006 |
| EP | 1 840 490 A2 | 10/2007 |

OTHER PUBLICATIONS

International Search Report and Written Opinion of Corresponding Application No. PCT/US2016/027732; Dated Jul. 15, 2016.

*Primary Examiner* — Daniel J Troy
*Assistant Examiner* — Andres F Gallego
(74) *Attorney, Agent, or Firm* — Pearne & Gordon LLP

(57) ABSTRACT

A storage assembly supports and stores storage units at a storage facility such as a refrigerated compartment interior. The storage assembly can include (1) support bars that extend between each support bar's first end and second end and are mounted within the storage facility and (2) storage unit carriers that are supported at the support bars, with the storage unit carriers including a holding structure configured to selectively hold and release a storage unit. Either the support bars can be mounted within the storage facility for selective positioning within the storage facility at a plurality of locations laterally of the direction in which the support bars extend, or the storage unit carriers can be supported at the support bars for selective positioning at a plurality of locations along the support bars between each support bar's first end and second end. Alternatively, both arrangements can be implemented.

7 Claims, 3 Drawing Sheets

(56) References Cited

U.S. PATENT DOCUMENTS

2003/0189141 A1 10/2003 Turvey et al.
2005/0231084 A1 10/2005 Dallman et al.
2011/0120173 A1 5/2011 Olefson
2014/0346129 A1* 11/2014 Hall ..... A47J 47/16
211/162

* cited by examiner

STORAGE ASSEMBLIES FOR DISCRETE STORAGE UNITS

FIELD OF THE INVENTION

The present invention relates, in general, to storage assemblies and, in particular, to storage assemblies that possess a capability of supporting and storing individualized storage units such as flexible storage bags for example.

BACKGROUND OF THE INVENTION

Storage assemblies of many types are known in the art. Many of the storage assemblies are particularly applicable to the storing of items at refrigerated appliances. Oftentimes, articles stored in refrigerated appliances are stored in an aggregative manner and are not readily accessed individually. A need has been identified for storage assemblies that provide for the discrete storing of storage units, such as flexible storage bags for example, in a manner that allows the storage space for each storage unit to be adapted to the size of the storage unit so that the storage units can be readily and efficiently stored away and easily accessed.

BRIEF SUMMARY OF THE INVENTION

The following presents a simplified summary of the invention in order to provide a basic understanding of selected aspects of the invention. The summary does not comprise an extensive overview of the invention nor is the summary intended to identify key or critical elements of the invention or to delineate the scope of the invention. The sole purpose of the summary is to present selected concepts of the invention in a simplified form as a prelude to the more detailed description that is presented later herein.

According to one aspect of the present invention, an appliance can include at least one refrigerated compartment that has a refrigerated compartment interior at which a storage assembly that is configured to support and store one or more discrete storage units is located. The storage assembly can include one or more support bars. At least one of the one or more support bars can extend between a support bar first end and a support bar second end and be mounted and supported within the refrigerated compartment interior. The storage assembly also can include one or more storage unit carriers supported at the at least one of the one or more support bars. At least one of the one or more storage unit carriers can include a holding structure that is configured to selectively alternatively hold and release a storage unit at the one or more storage unit carrier.

According to another aspect, either the one or more support bars can be mounted within the refrigerated compartment interior for selective positioning within the refrigerated compartment at a plurality of locations laterally of the direction in which the one or more support bars extend or the one or more storage unit carriers that can be supported at the at least one of the one or more support bars can be supported for selective positioning at a plurality of locations along the at least one of the one or more support bars between the support bar first end and the support bar second end.

According to a further aspect, both the one or more support bars can be mounted within the refrigerated compartment interior for selective positioning within the refrigerated compartment at a plurality of locations laterally of the direction in which the one or more support bars extend and the one or more storage unit carriers that can be supported at the at least one of the one or more support bars can be supported for selective positioning at a plurality of locations along the at least one of the one or more support bars between the support bar first end and the support bar second end.

According to an additional aspect, a first supporting structure and a second supporting structure can be located at the refrigerated compartment interior for supporting the support bars. The support bar first end of at least one of the one or more support bars can be slidably supported at the first supporting structure, and the support bar second end of the at least one of the one or more support bars can be slidably supported at the second supporting structure. As a result, the at least one of the one or more support bars can be selectively slidably positioned within the refrigerated compartment interior at a plurality of locations laterally of the direction in which the at least one of the one or more support bars extend.

According to yet another aspect, the one or more storage unit carriers supported at the at least one of the one or more support bars for selective positioning at a plurality of locations along the at least one of the one or more support bars between the support bar first end and the support bar second end can be slidably supported at the at least one the one or more support bars. As a result, the one or more storage unit carriers can be selectively slidably positioned at a plurality of locations along the at least one or more support bars between the support bar first end and the support bar second end.

According to yet a further aspect, a storage assembly can include a first supporting structure that is configured to be installed at a variety of storage facilities and a second supporting structure that is configured to be installed at those storage facilities. The storage assembly also can include one or more support bars. At least one of the one or more support bars can extend between a support bar first end and a support bar second end, wherein the support bar first end of at least one of the one or more support bars is mounted to the first supporting structure for selective positioning of the support bar first end along a length of the first supporting structure; and the support bar second end of at least one of the one or more support bars can be mounted to the second supporting structure for selective positioning of the support bar second end along a length of the second supporting structure. One or more storage unit carriers can be supported at the at least one of the one or more support bars, and at least one of the one or more storage unit carriers can include a holding structure that is configured to hold and release a respective storage unit at the storage unit carrier, wherein the one or more storage unit carriers that are supported at the at least one of the one or more support bars are supported for selective positioning at a plurality of locations along the at least one of the one or more support bars between the support bar first end and the support bar second end.

According to yet an additional aspect, with respect to the storage assembly described in the immediately preceding paragraph, the support bar first end of the at least one of the one or more support bars that can be mounted to the first supporting structure for selective positioning of the support bar first end along a length of the first supporting structure can be slidably supported at the first supporting structure; and the second end of the at least one of the one or more support bars that is mounted to the second supporting structure for selective positioning of the support bar second end along a length of the second supporting structure can be slidably supported at the second supporting structure. Also, the one or more storage unit carriers supported at the at least one of the one or more support bars for selective positioning at a plurality of locations along the at least one of the one or more support bars between the support bar first end and the support bar second end can be slidably supported at the at least one of the one or more support bars.

According to still another aspect, with respect to all the aforementioned storage assemblies, at least one of the one or more storage unit carriers can include a storage unit carrier first portion that can be supported at a support bar and a storage unit carrier second portion that includes the holding structure and is connected to the storage unit carrier first portion.

According to still a further aspect, the holding structure can include a slot that is open at a slot first end for the insertion into the slot through the slot first end of a retaining portion of the storage unit. The holding structure also can include a restraining element that is movable into and out of restraining engagement with the retaining portion of the storage unit to selectively alternatively retain and release, respectively, the storage unit at the holding structure.

According to still an additional aspect, the restraining element can include a spherical component that is displaceable along a surface of an incline gradually decreasing in thickness from an incline first end located toward the slot opening to an incline second end located upward of the incline first end. The spherical component and the incline can be juxtaposed with relation to one another such that the spherical component when positioned toward the incline first end is located within the slot to a sufficient extent to be in restraining engagement with the retaining portion of the storage unit and when positioned toward the incline second end is removed from the slot sufficiently to release the storage unit from the holding structure.

The description that follows and the accompanying drawings set forth in detail certain illustrative aspects of the invention. These aspects are indicative, however, of only a few of the various ways in which the principles of the invention may be employed, and the present invention is intended to include not only these certain illustrative aspects but all aspects of the invention and their equivalents. Other objects, advantages and novel features of the invention will become apparent from the following detailed description of the invention when considered in conjunction with the accompanying drawings.

BRIEF DESCRIPTION OF THE DRAWINGS

The foregoing and other features and advantages of the present invention will become apparent to those skilled in the art to which the present invention relates upon reading the description below with reference to the accompanying drawings, in which.

DESCRIPTION OF EXAMPLE EMBODIMENTS

Figure 1:
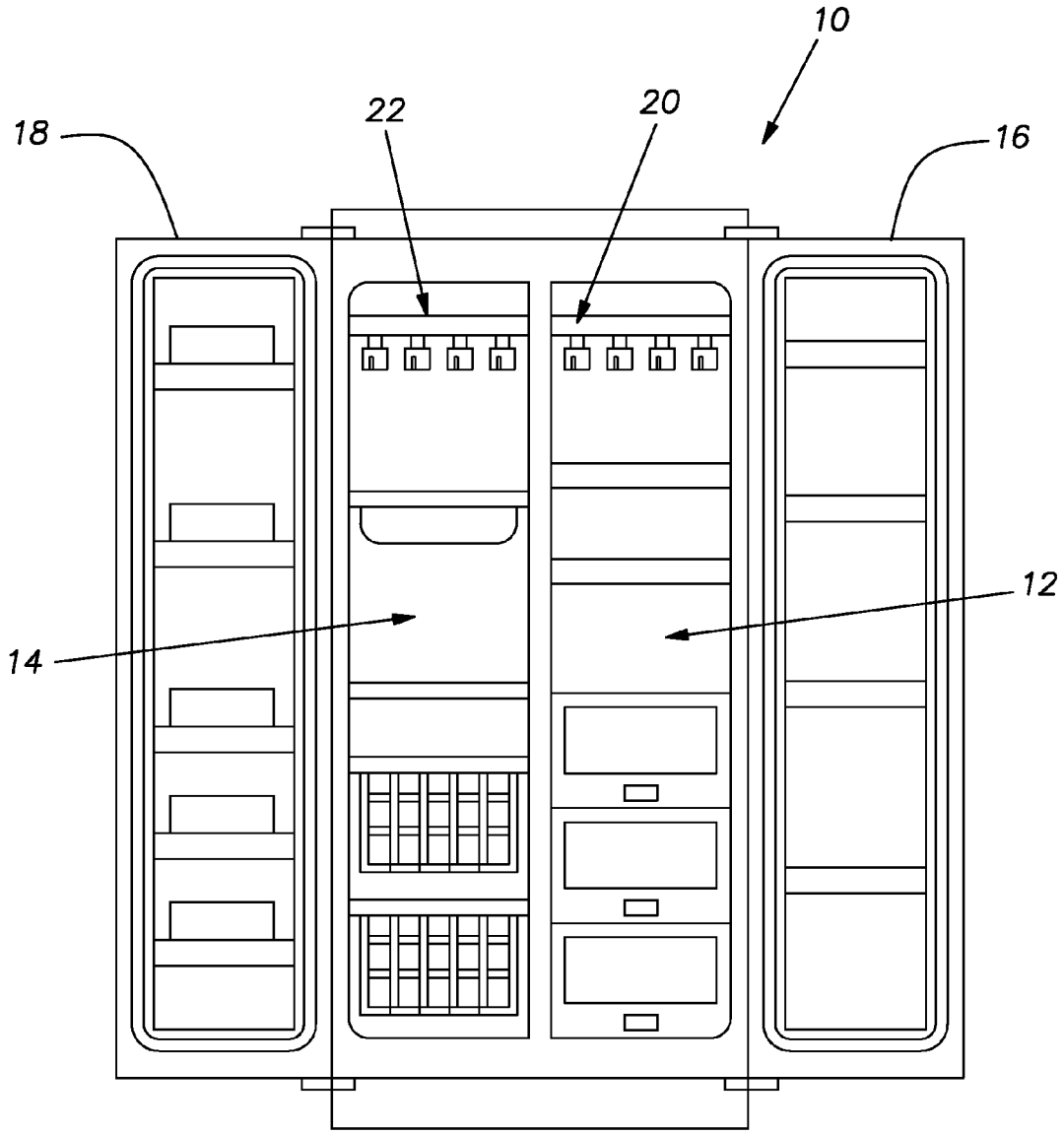
FIG. 1 is a somewhat schematic elevated front view of an embodiment of the invention, wherein an example of a storage assembly according to the invention is shown incorporated at a refrigeration appliance.

The present invention will now be described with reference to the drawings, wherein like reference numerals are used to refer to like elements throughout. It is to be appreciated that the various drawings are not necessarily drawn to scale from one figure to another or within a given figure. Also, the sizes of the components are somewhat arbitrarily drawn in order to facilitate an understanding of the drawings. In the following description, numerous specific details are set forth in order to provide a thorough understanding of the present invention, but it can be possible in certain instances to practice the present invention without those specific details.

Referring first to FIG. 1, there is illustrated an example embodiment of the present invention comprising an appliance that includes at least one refrigerated compartment that includes a refrigerated compartment interior at which a storage assembly configured to support and store one or more storage units is located and maintained. In the embodiment of FIG. 1, the illustrated appliance comprises a conventional side-by-side household refrigerator, indicated generally at 10, that includes two refrigerated compartments—a fresh food compartment having a fresh food compartment interior, indicated generally at 12, and a freezer compartment having a freezer compartment interior, indicated generally at 14. A first closure, comprising door 16, is provided to selectively alternatively close off and open up access to the fresh food compartment interior 12, and a second closure, comprising door 18, is provided to selectively alternatively close off and open up access to the freezer compartment 14. The refrigerator 10 can include the typical kinds of storage drawers, baskets and shelves that are conventionally provided in household refrigerators as indicated schematically in the example embodiment of FIG. 1.

Also in the example embodiment of FIG. 1, a first storage assembly, indicated generally at 20, configured to support and store storage units, is located and maintained at the fresh food compartment interior 12; and a second storage assembly, indicated generally at 22, also configured to support and store storage units, is located and maintained at the freezer compartment interior 14. The first storage assembly 20 and the second storage assembly 22 can have identical constructs or the construct of each can be different from the other. Additionally, the storage facility at which the storage assembly is located and maintained can comprise any kind of storage facility at which it is desired to support and store individual storage units. For example, the storage assemblies of the invention can be located at cupboards, cabinets, drawers and shelves in general; and as far as refrigerated appliances are concerned, the storage assemblies of the invention can be located at the interiors of most any kind of refrigerated appliance, including for example, stand-alone freezers, refrigerated appliances that include only fresh food compartments, bottom-mounted refrigerators and top-mounted refrigerators, and the storage assemblies of the invention are not limited to being located at side-by-side refrigerators only.

Figure 2:
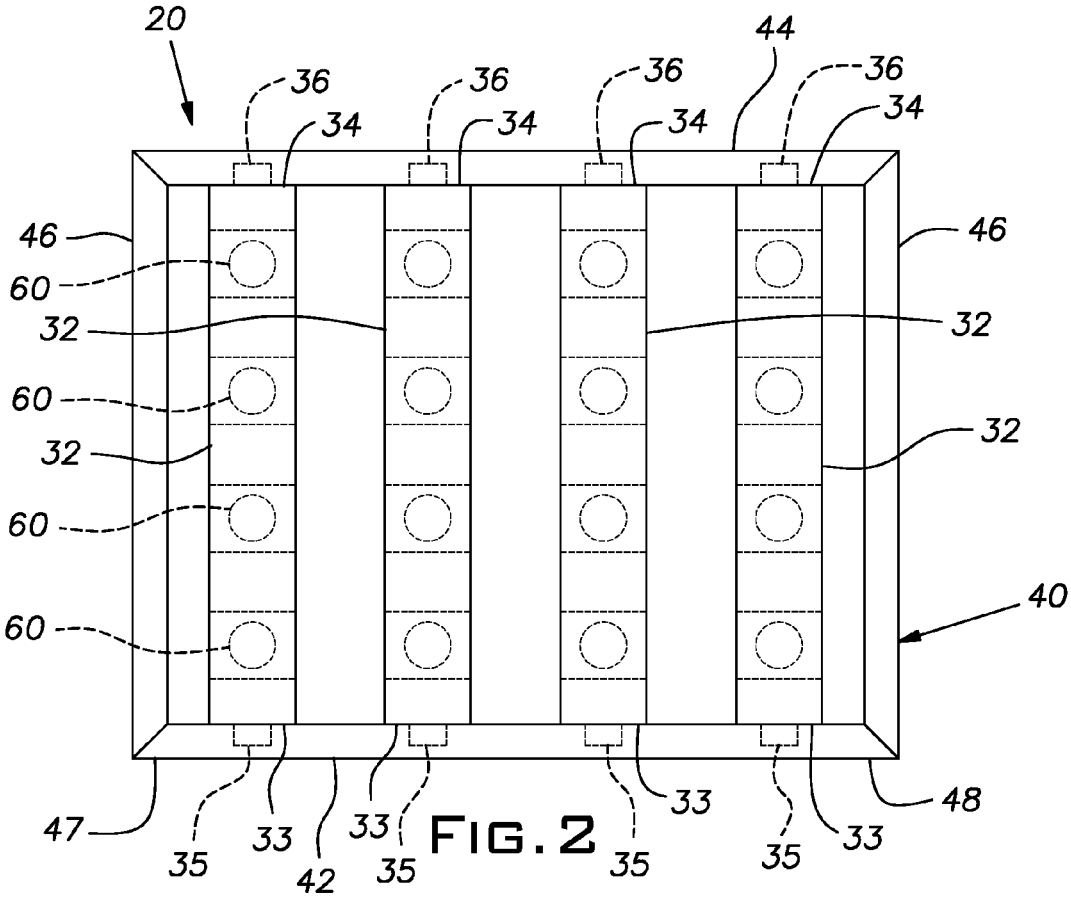
FIG. 2 is a somewhat schematic top view of the example of the storage assembly of FIG. 1.

A top view of an example embodiment of a storage assembly that can serve as either or both the first storage assembly 20 and the second storage assembly 22 is shown in FIG. 2. In the following description, reference is made to only the first storage assembly 20, but the description is also applicable to the construct of the second storage assembly 22 which, as indicated, can be, but is not necessarily, identical to the first storage assembly 20.

According to the principles of the present invention, the storage assembly can include one or more support bars with at least one of the one or more support bars extending between a support bar first end and a support bar second end and mounted within the refrigerated compartment interior. In the example embodiment of FIG. 2, four support bars 32 are provided although any number of support bars—less than four or more than four—can be used. Each support bar 32 is mounted in a manner described below at the refrigerated compartment interior comprising the fresh food compartment interior 12 and extends between a support bar first end 33 and a support bar second end 34. As will become more apparent from the description below, the one or more support bars are mounted at the refrigerated compartment interior comprising the fresh food compartment interior 12 for selective positioning within the refrigerated compartment interior at a plurality of locations laterally of the direction in which the one or more support bars extend. In the example embodiment all four support bars are mounted for selective positioning at a plurality of locations. However, it is not required that this be the case and one or more support bars can be stationary.

The mounting of the support bars 32 at the fresh food compartment interior 12 can be variously accomplished. According to one aspect of the present invention, a first supporting structure that is located at the refrigerated compartment interior and a second supporting structure that is located at the refrigerated compartment interior serve to support the support bars 32. In the example embodiment of FIG. 2, the mounting of the support bars 32 involves the use of a supporting frame, indicated generally at 40, that includes a first supporting structure 42, a second supporting structure 44 and side members 46 and is located at the refrigerated compartment interior. The frame 40 can be secured at its side members 46, for example, to the walls that define the fresh food compartment interior 12 using suitable fasteners as will be familiar to those having ordinary skill in the art. Alternatively, for example, a mounting structure can be provided at the fresh food compartment interior and the frame 40 can be configured so as to be removably secured to the mounting structure as will be understood by those having ordinary skill in the art.

Figure 5:
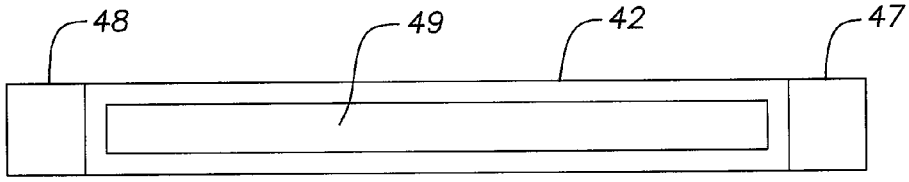
FIG. 5 is a front elevational view of a supporting structure for the example support bar of FIG. 3.

An example embodiment of the first supporting structure 42 is show in FIG. 5 which is an elevational view of the first supporting structure 42 viewed from the interior of the frame 40. The first supporting structure includes a first supporting structure first end 47 and a first supporting structure second end 48. A longitudinal groove 49 that extends between the first supporting structure first end 47 and the first supporting structure second end 48 is provided at the first supporting structure 42. The second supporting structure 44 can be of the same construct as the first supporting structure 42.

Figure 3:
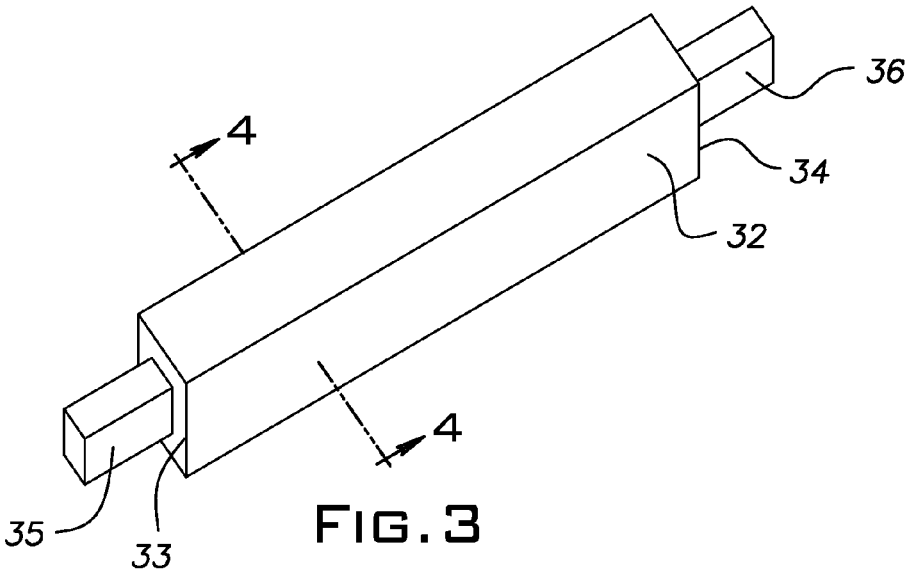
FIG. 3 is a perspective view of an example of a support bar provided at the embodiment of the storage assembly of FIG. 1.

As best seen in FIG. 3, a first support bar extension 35 is located at the support bar first end 33 and a second support bar extension 36 is located at the support bar second end 34. The support bar first end 33 of at least one of the one or more support bars 32 is slidably supported at the first supporting structure 42 and the support bar second end 34 of the at least one of the one or more support bars 32 is slidably supported at the second supporting structure 44. Thereby, the at least one of the one or more support bars 32 can be selectively slidably positioned within the refrigerated compartment interior comprising the fresh food compartment interior 12 at a plurality of locations laterally of the direction in which the at least one of the one or more support bars extend. More specifically, in the example embodiment illustrated in the figures, each support bar first end 33 is slidably supported at the first supporting structure 42 by means of the first support bar extension 35 being located in the longitudinal groove 49 of the first supporting structure 42 for sliding movement therein; and each support bar second end 34 is slidably supported at the second supporting structure 44 by means of the second support bar extension 36 being located in a similar groove in the second supporting structure 44 for sliding movement therein. The sliding movement can take place in a direction either toward the first supporting structure first end 47 and away from the first supporting structure second end 48 or in a direction toward the first supporting structure second end 48 and away from the first supporting structure first end 47.

It will be understood that the support bars 32 can be supported for selective positioning within the refrigeration appliance interior at a plurality of locations laterally of the direction in which the support bars extend other than through the means of a sliding support. For example, each of the first supporting structure 42 and the second supporting structure 44, rather than including the groove 49, can be notched at their tops and the first support bar extension 35 and the second support bar extension 36 of the one or more support bars removably inserted into selected ones of the notches at the first supporting structure 42 and the second supporting structure 44, respectively, and the positioning of the support bars adjusted in that manner.

The storage assembly 20 also includes one or more storage unit carriers that are supported at the at least one of the one or more support bars. In the example embodiment illustrated in the figures, as shown in FIG. 2, each support bar 32 includes four storage unit carriers 60. However more than four or less than four storage unit carriers can be included at the support bars 32, and it is not required that the same number of storage unit carriers 60 be provided at each support bar 32. As described in greater detail below, at least one of the one or more storage unit carriers includes a holding structure that is configured to selectively alternately hold and release a storage unit at the one or more storage unit carriers.

Figure 4:
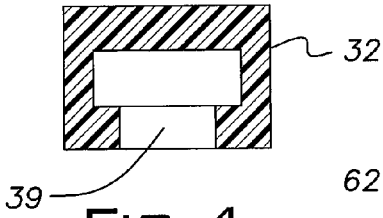
FIG. 4 is a cross-sectional view taken at the line 4-4 of FIG. 3.
Figure 6:
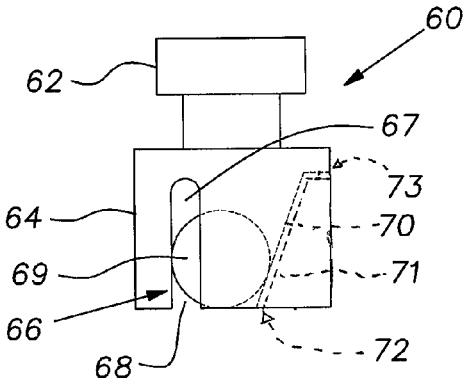
FIG. 6 is a front elevational view of an example of a storage unit carrier provided at the example of the storage assembly of FIG. 1.
Figure 7:
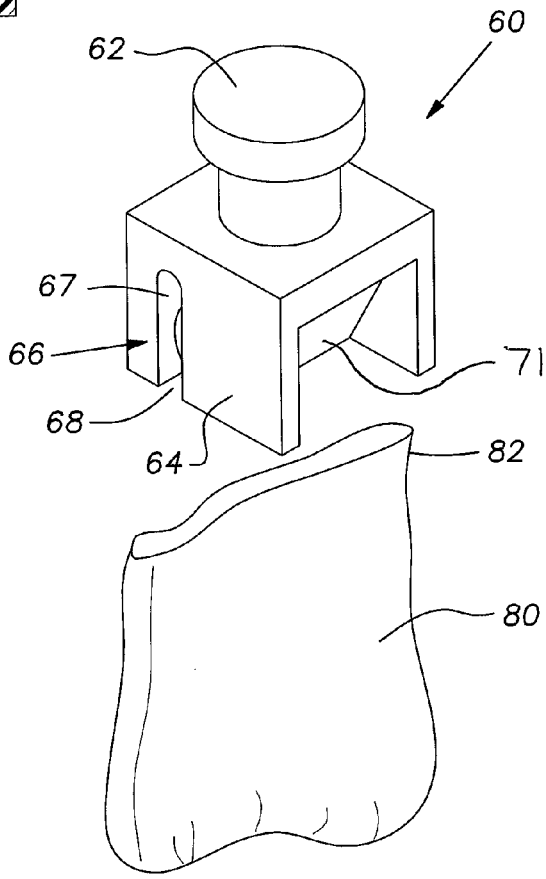
FIG. 7 is a perspective view of the storage unit carrier example of FIG. 6 and an example of a storage unit, in the form of a flexible storage bag, that can be held for storage at the storage unit carrier example.

The one or more storage unit carriers 60 supported at the at least one or more of the one or more support bars 32 are supported at the at least one of the one or more support bars 32 for selective positioning at a plurality of locations along the at least one of the one or more support bars 32 between the support bar first end 33 and the support bar second end 34. More specifically, as shown in FIGS. 4, 6 and 7, in the example embodiment, at least one of the one or more storage unit carriers 60 includes a storage unit carrier first portion 62 that is supported at a support bar 32 within a recess 39 in the support bar, as shown in FIG. 4. In the example embodiment, the recess 39 extends between the support bar first end 33 and the support bar second end 34. At least one of the one or more storage unit carriers also includes a second portion 64 that includes the holding structure, indicated generally at 66, of the one or more storage unit carriers. The storage unit carrier second portion 64 is connected to the storage unit carrier first portion 62 so as to be integral therewith.

It will be understood from the foregoing description that the one or more storage unit carriers 60 are slidably supported at the at least one of the one or more support bars 32, whereby the one or more storage unit carriers can be selectively slidably positioned at a plurality of locations along the at least one or more support bars between the support bar first end 33 and the support bar second end 34. This sliding support is accomplished through the instrumentalities of the recess 39, which can extend the length of the support bar 32, and the storage unit first portion 62, which is slidably received within the recess 39. The one or more storage unit carriers 60 can be selectively slidably positioned at a plurality of locations along at least one of the one or more support bars 32 between the support bar first end 33 and the support bar second end 34. Of course, it is not required that the recess 39 extend the entire length of the support bar 32 nor is it required that every storage unit carrier 60 be supported at the support bar 32 for selective positioning. One or more of the storage unit carriers can be fixed in place at the support bar 32. Additionally, it is not required that the selective positioning of the storage unit carriers be accomplished by means of a sliding connection between the support bars 32 and the storage unit carriers 60. For example, a plurality of separate connection sites can be provided at the support bars 32 for the removable installation of the storage unit carriers. Thus, the support bars can be provided with a plurality of spaced apart hooks at which the storage unit carriers 60 can be attached by means of eyes provided at the first portion 62 of the storage unit carriers 60.

The holding structure 66 of the storage unit carrier second portion 64 of the storage unit carrier 60 is constructed so as to hold in place a storage unit such as a plastic storage bag 80 for example as indicated in FIG. 7. Thus, the holding structure 66 includes a slot 67 that is open at a slot first end 68 for the insertion into the slot 67 through the slot first end 68 a retaining portion of the storage unit that can comprise any portion of the plastic storage bag 80 but, typically, will comprise the top 82 of the plastic storage bag. The holding structure 66 also includes a restraining element that is movable into and out of restraining engagement with the retaining portion of the storage unit to selectively retain and release, respectively, the storage unit at the holding structure. In the example embodiment of the holding structure 66 of the storage unit carrier 60, the restraining element comprises a spherical component 69 that is displacable along a surface 70 of an incline 71. The incline 71 gradually decreases in thickness from an incline first end 72 located toward the slot opening 68 to an incline second end 73 located upward of the incline first end 72. The incline 71 and the spherical component 69 are juxtaposed with relation to one another such that the spherical component 69, when positioned toward the incline first end 72 is located within the slot 69 to a sufficient extent to be in restraining engagement with the retaining portion of the storage unit and when positioned toward the incline second end 73 is removed from the slot 69 sufficiently to release the storage unit from the holding structure. Thus, as will be understood by one having ordinary skill in the art, an edge of a storage unit comprising a retaining portion of the storage unit, such as the top 82 of the plastic storage bag 80 for example, can be directed upwardly in the slot 67 through the open end of the slot 68. As that movement occurs, the spherical component 69 will tend to move upwardly along the surface 70 of the incline 71 allowing the top 82 of the bag 80 to be inserted into the slot 68 a sufficient distance such that, upon the release of the plastic storage bag, the spherical component 69, because of its tendency to move downwardly over the surface 70 will grasp the top 82 of the plastic storage bag 80 and support the plastic storage bag for storage thereat. It will be understood by those skilled in the art, that, rather than comprising the spherical component 69, the restraining element can comprise another structure, such as a cylinder for example, that has the ability of rolling or sliding along the surface 70 of the incline 71.

It will be understood from the foregoing description that the invention as represented by the illustrated example embodiment, through the selective positioning of the support bars 32 and the selective positioning of the storage unit carriers 60, will allow for the extensive selective positioning of storage units, such as plastic storage bags for example, to accommodate different size storage units and otherwise provide the user with great flexibility in performing storage tasks. However, also as indicated above, the comprehensive selectivity that is available can be limited if desired. For example, storage assemblies can be provided according to the principles of the invention wherein only the one or more support bars are mounted within the refrigerated compartment interior for selective positioning within the refrigerated compartment at a plurality of locations laterally of the direction in which the one or more support bars extend or only the one or more storage unit carriers supported at the at least one of the one or more support bars are supported for selective positioning at a plurality of locations along the at least one of the one or more support bars between the support bar first end and the support bar second end. Alternatively, as described herein, both of these arrangements can be provided.

As indicated above, the storage assembly of the present invention is not limited to being applied to refrigerated compartments and has applicability to other storage facilities. In such contexts, the storage assembly could include a first supporting structure configured to be installed at the storage facility and a second supporting structure configured to be installed at that storage facility. One or more support bars, such as the support bars 32 for example, that extend between a support bar first end and support bar second end could be provided such that the support bar first end of at least one of the one or more support bars is mounted at the first supporting structure for selective positioning of the support bar first end along a length of the first supporting structure and the support bar second end of at least one of the one or more support bars is mounted to the second supporting structure for selective positioning of the support bar second end along a length of the second supporting structure. Additionally, one or more storage unit carriers, such as the storage unit carriers 60 for example, supported at the at least one of the one or more support bars could be included with at least one of the one or more storage unit carriers including a holding structure configured to hold and release a respective storage unit at the storage unit carrier, wherein the one or more storage unit carriers supported at the at least one of the one or more support bars are supported for selective positioning at a plurality of locations along the at least one of the one or more support bars between the support bar first end and the support bar second end. A storage assembly as described could have the support bar first end of the at least one of the one or more support bars that is mounted to the first supporting structure for selective positioning of the support bar first end along a length of the first supporting structure slidably supported at the first supporting structure and the second end of the at least one of the one or more support bars that is mounted to the second supporting structure for selective positioning of the support bar second end along a length of the second supporting structure slidably supported at the second supporting structure. Finally, the one or more storage unit carriers supported at the at least one of the one or more support bars for selective positioning at a plurality of locations along the at least one of the one or more support bars between the support bar first end and the support bar second end could be slidably supported at the at least one of the one or more support bars.

The invention has been described above using specific examples; however, it will be understood by those having ordinary skill in the art that various alternatives may be used and equivalents may be substituted for elements or steps described herein without deviating from the scope of the invention. Modifications may be necessary to adapt the invention to a particular situation or to particular needs without departing from the scope of the invention. It is intended that the invention not be limited to the particular implementations described herein, but that the claims be given their broadest interpretation to cover all embodiments, literal or equivalent, covered thereby.

What is claimed is:

1. An appliance including:

at least one refrigerated compartment that includes a refrigerated compartment interior at which a storage assembly configured to support and store one or more storage units is located, the storage assembly including:

a plurality of support bars, at least one of the plurality of support bars extending between a support bar first end and a support bar second end and mounted within the refrigerated compartment interior; and a plurality of storage unit carriers supported at the at least one of the plurality of support bars, each storage unit carrier including a holding structure configured to selectively alternatively hold and release an individual storage unit at each storage unit carrier, wherein the plurality of support bars are mounted within the refrigerated compartment interior for selective slidable positioning within the refrigerated compartment at a plurality of locations laterally of the direction in which the plurality of support bars extend and the plurality of storage unit carriers supported at the plurality of support bars are supported for selective slidable positioning at a plurality of locations along the at least one of the plurality of support bars between the support bar first end and the support bar second end, and wherein at least one of the plurality of storage unit carriers includes:

a storage unit carrier first portion that is slidably supported within a recess of at least one of the plurality of support bars, the storage unit carrier first portion comprising a circular disk geometry that is capable of rotation within said recess; and a storage unit carrier second portion that includes the holding structure depending below and connected to the storage unit carrier first portion; and wherein the holding structure includes: a slot that is open at a slot first end for the insertion into the slot through the slot first end a retaining portion of the storage unit; and a restraining element that is movable into and out of restraining engagement with the retaining portion of the storage unit to selectively alternatively retain and release, respectively, the storage unit at the holding structure.

2. The appliance of claim 1, including a first supporting structure located at the refrigerated compartment interior and a second supporting structure located at the refrigerated compartment interior, wherein the support bar first end of at least one of the plurality of support bars is slidably supported at the first supporting structure and the support bar second end of the at least one of the plurality of support bars is slidably supported at the second supporting structure, whereby the at least one of the plurality of support bars can be selectively slidably positioned within the refrigerated compartment interior at a plurality of locations laterally of the direction in which the at least one of the plurality of support bars extend.

3. The appliance of claim 2 wherein the restraining element comprises a spherical component that is displaceable along a surface of an incline extending from an incline first end located toward the slot first end to an incline second end located upward of the incline first end, the spherical component and the incline being juxtaposed with relation to one another such that the spherical component when positioned toward the incline first end is located within the slot to be in restraining engagement with the retaining portion of the storage unit and when positioned toward the incline second end is removed from the slot to release the storage unit from the holding structure.

4. The appliance of claim 1, wherein the restraining element comprises a spherical component that is displaceable along a surface of an incline extending from an incline first end located toward the slot first end to an incline second end located upward of the incline first end, the spherical component and the incline being juxtaposed with relation to one another such that the spherical component when positioned toward the incline first end is located within the slot to be in restraining engagement with the retaining portion of the storage unit against a wall of the slot and when positioned toward the incline second end is removed from the slot to release the storage unit from the holding structure.

5. A storage assembly for an appliance, including:

a first supporting structure configured to be installed at a storage facility of said appliance;

a second supporting structure configured to be installed at the storage facility of said appliance;

a plurality of support bars, at least one of the plurality of support bars extending between a support bar first end and support bar second end, wherein the support bar first end of at least one of the plurality of support bars is mounted at the first supporting structure for slidable selective positioning of the support bar first end along a length of the first supporting structure and the support bar second end of at least one of the plurality of support bars is mounted to the second supporting structure for slidable selective positioning of the support bar second end along a length of the second supporting structure;

a plurality of storage unit carriers supported at the plurality of support bars and more than one of the storage unit carriers supported at at least one of the plurality of support bars, each storage unit carrier including a holding structure configured to hold and release an individual storage unit at each storage unit carrier, wherein the plurality of storage unit carriers supported at the at least one of the plurality of support bars are individually slidably supported for selective positioning at a plurality of locations along the at least one of the plurality of support bars between the support bar first end and the support bar second end, wherein at least one of the plurality of storage unit carriers includes:

a storage unit carrier first portion that is slidably supported within a recess of at least one of the plurality of support bars, the storage unit carrier first portion comprising a circular disk geometry that is capable of rotation within said recess; and a storage unit carrier second portion that includes the holding structure depending below and connected to the storage unit carrier first portion; and wherein the holding structure includes: a slot that is open at a slot first end for the insertion into the slot through the slot first end a retaining portion of the storage unit; and a restraining element that is movable into and out of restraining engagement with the retaining portion of the storage unit to selectively alternatively retain and release, respectively, the storage unit at the holding structure.

6. The storage assembly of claim 5 wherein:

the support bar first end of the at least one of the plurality of support bars that is mounted to the first supporting structure for selective positioning of the support bar first end along a length of the first supporting structure is slidably supported at the first supporting structure and the second end of the at least one of the plurality of support bars that is mounted to the second supporting structure for selective positioning of the support bar second end along a length of the second supporting structure is slidably supported at the second supporting structure; and the plurality of storage unit carriers supported at the at least one of the plurality of support bars for selective positioning at a plurality of locations along the at least one of the plurality of support bars between the support bar first end and the support bar second end is slidably supported at the at least one of the plurality of support bars.

7. The storage assembly of claim 5 wherein the restraining element comprises a spherical component that is displaceable along a surface of an incline extending from an incline first end located toward the slot first end to an incline second end located upward of the incline first end, the spherical component and the incline being juxtaposed with relation to one another such that the spherical component when positioned toward the incline first end is located within the slot to be in restraining engagement with the retaining portion of the storage unit and when positioned toward the incline second end is removed from the slot to release the storage unit from the holding structure.

* * * * *